US005156105A

United States Patent [19]

Wang

[11] Patent Number: 5,156,105

[45] Date of Patent: Oct. 20, 1992

[54] THREAD TENSION ADJUSTING DEVICE FOR A SEWING MACHINE

[76] Inventor: Shui-Nu Wang, 6, Nan Pin Road, Taichung, Taiwan

[21] Appl. No.: 763,609

[22] Filed: Sep. 23, 1991

[51] Int. Cl.[5] ..... D058 47/02

[52] U.S. Cl. ..... 112/254; 242/150 R

[58] Field of Search ..... 112/254, 255, 302; 242/150 R

[56] References Cited

U.S. PATENT DOCUMENTS 3,311,311 3/1967 Furst ..... 242/150 R 4,803,936 2/1989 Mikuni et al. ..... 112/254

FOREIGN PATENT DOCUMENTS 63-257592 10/1988 Japan ..... 112/254

*Primary Examiner*—Werner H. Schroeder

*Assistant Examiner*—Paul C. Lewis

[57] ABSTRACT

A device including an axle rotatably supported in a sewing machine, a shaft fixed in parallel to the axle, one or more cams fixed on the axle, a lever having one end pivotally fixed and having the other end slidably engaged with the cam, and a gripping device including a pair of members disposed on the shaft and a spring disposed between the lever and the members so that a thread can be gripped between the members, and the lever can be caused to move toward or to move away from the members so that a tension force applied to the thread can be adjusted.

2 Claims, 4 Drawing Sheets

THREAD TENSION ADJUSTING DEVICE FOR A SEWING MACHINE

BACKGROUND OF THE INVENTION (a) Field of the Invention

The present invention relates to an adjusting device, and more particularly to a thread tension adjusting device for a sewing machine.

(b) Description of the Prior Art

A typical sewing machine includes at least one gripping device for gripping the thread during sewing operations. However, no devices are provided for adjusting the tension forces of two or more gripping devices simultaneously.

The present invention has arisen to mitigate and/or obviate the afore-described disadvantages of the conventional sewing machines.

SUMMARY OF THE INVENTION

The primary objective of the present invention is to provide a thread tension adjusting device for a sewing machine in order to adjust the tension force applied to the thread.

In accordance with one aspect of the present invention, there is provided an adjusting device for a sewing machine which has an arm for accommodating the adjusting device, the adjusting device including an axle rotatably supported in the arm and having one end extended outward of the arm for supporting a knob, a shaft fixed in the arm in parallel to the axle, one or more cams fixed on the axle, a lever having one end pivotally fixed on the arm and having the other end slidably engaged on the shaft and having a protrusion formed on a middle portion for slidable engagement with the cam, and a gripping device disposed beside the other end of the lever and including a pair of members disposed on the shaft and a spring disposed between the other end of the lever and the members for biasing the members together so that a thread can be gripped between the members, and the other end of the lever can be caused to move toward or to move away from the members when the axle and the cam are rotated so that a tension force applied to the thread can be adjusted.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
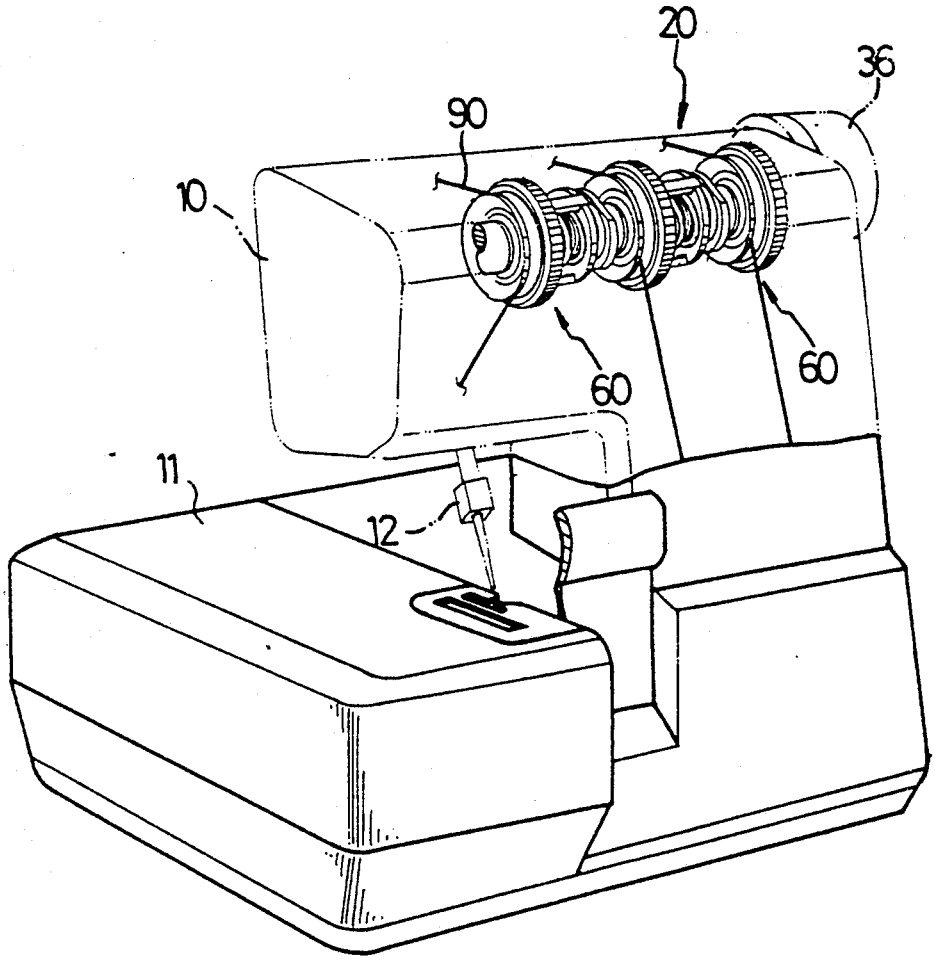
FIG. 1 is a perspective view of a sewing machine.

Referring to the drawings and initially to FIG. 1, a typical sewing machine comprises generally an arm 10 disposed on a base 11 and a needle 12 extended downward from a free end portion of the arm 10 for conducting sewing operations. A thread tension adjusting device 20 in accordance with the present invention is generally disposed in the arm 10 for adjusting tension force applied to the thread(s) 90.

Referring next to FIGS. 2 to 5, the adjusting device 20 is disposed in a casing 91 which is disposed in the arm 10, or alternatively, the adjusting device 20 can be disposed directly in the arm 10 without the casing 91. The casing 91 includes a platform 92 formed thereon. The adjusting device 20 includes an axle 30 rotatably supported in the casing 91 and a shaft 50 fixed in the casing 91 by bolt 51 and in parallel to the axle 30. Three cams 32 are fixed on the axle 30 by such as bolts 33. Each of the cams 32 includes a cam surface 34 formed on one side thereof. The axle 30 has a first end extended outward of the casing 92.

A gear 35 and a knob 36 are fixed on the first end of the axle 30, the knob 36 extends outward of the arm 10 so that the axle 30 can be rotated by the knob 36. A pawl 37 which is resilient is fixed to the casing 91 and includes a bent portion 38 formed on the free end thereof for resiliently engagement with the gear 35 so that the gear 35 can be retained in place, best shown in FIG. 5.

A lever 40 is provided beside each of the cams 32 and has a first end 46 pivotally fixed on the platform 92 of the casing 91 by such as a bolt 41 and has a hole 42 formed in a second end 48 thereof. The shaft 50 extends through the holes 42 of the levers 40. A notch 43 is formed beside each of the holes 42. Each of the levers 40 includes a protrusion 44 formed in the middle portion thereof for engagement with the cam surface 34 of a respective cam 32.

Figure 2:
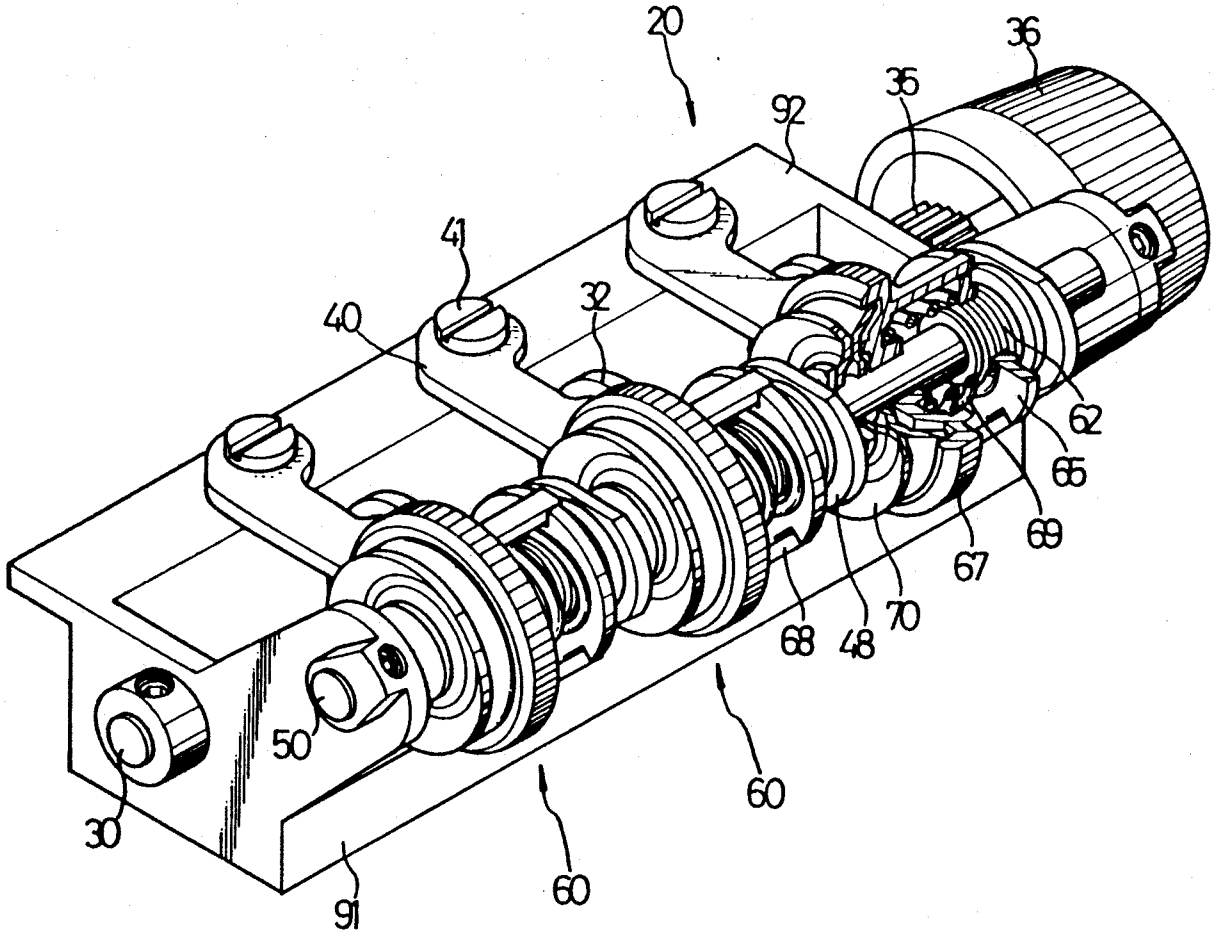
FIG. 2 is a perspective view of a thread tension adjusting device in accordance with the present invention.
Figure 3:
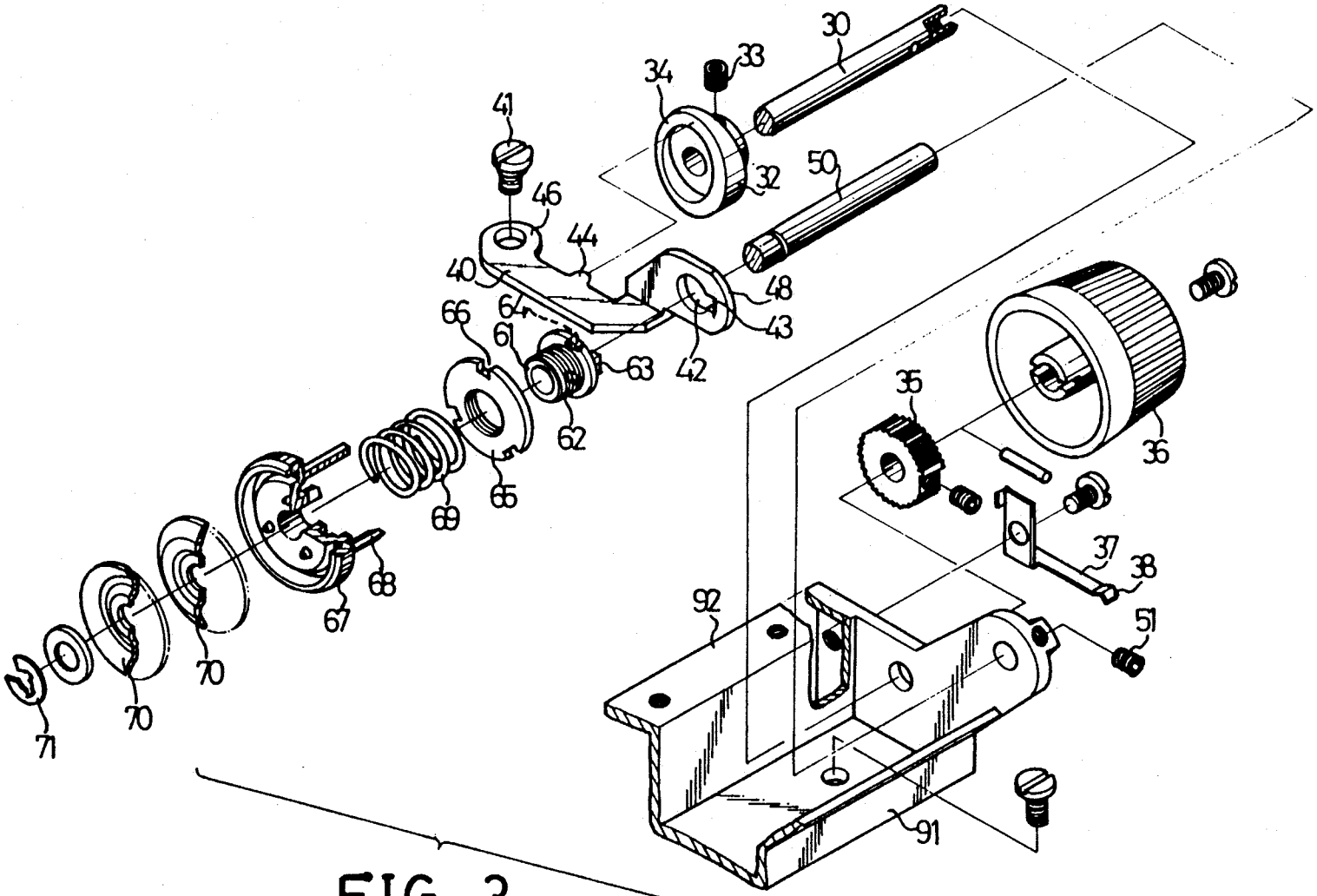
FIG. 3 is an exploded view of the thread tension adjusting device.
Figure 4:
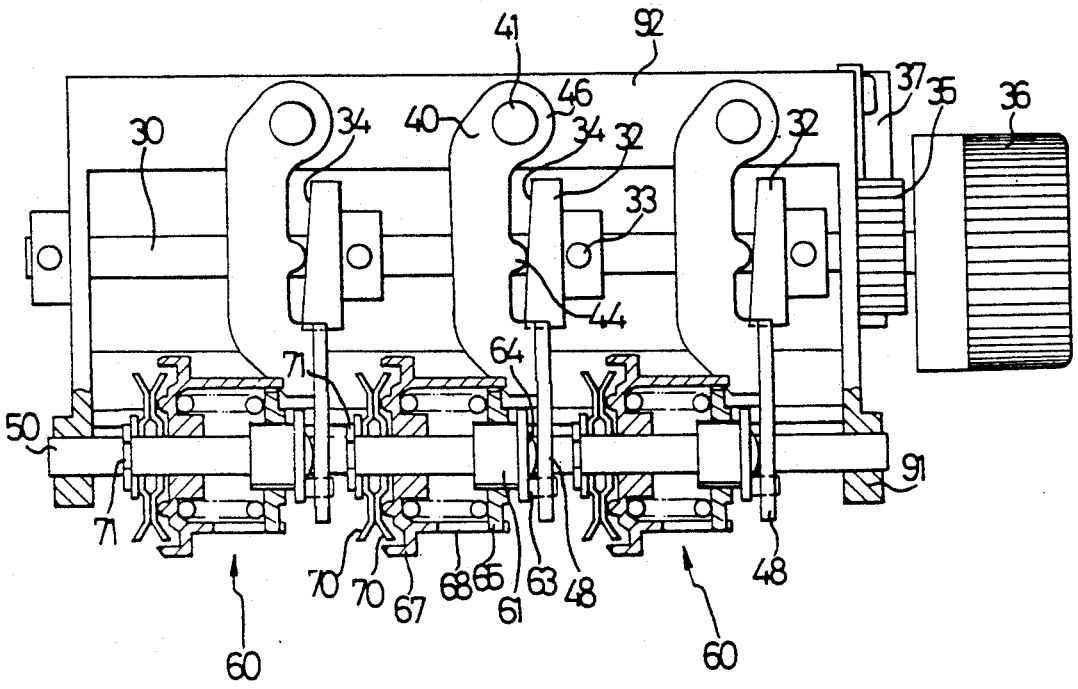
FIG. 4 is a top elevational view of the thread tension adjusting device.
Figure 5:
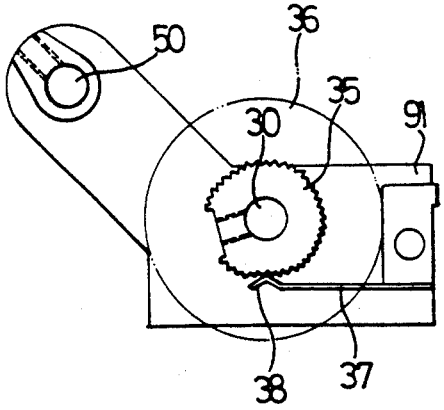
FIG. 5 is a schematic view illustrating the operation of the knob which is provided for operating the thread tension adjusting device.

As shown in FIGS. 2 and 4, three gripping devices 60 are disposed on the shaft 50 for gripping the threads 90 (FIG. 1). Each of the gripping devices 60 includes a sleeve 61 movably disposed on the shaft 50 and having an outer thread 62 formed thereon and having a key 63 and two projections 64 formed on one side thereof. The key 63 is engaged in the notch 43 of the lever 40 so that the sleeve 61 is prevented from rotating relative to the shaft 50 and is caused to move longitudinally along the shaft 50. A disc 65 is threaded on the sleeve 61 and includes three recesses 66 formed in the outer periphery thereof and equally spaced.

An element 67 is engaged on the shaft 50 and includes three legs 68 extended toward one side thereof for slidably engagement with the recesses 66 of the disc 65 respectively. A spring 69 is disposed between the disc 65 and the element 67 so that the projections 64 of the sleeve 60 can be caused to contact with the second end 48 of the lever 40. A pair of members 70 are disposed beside the element 67 and a retaining ring 71 is fixed on the shaft 50 beside the members 70 so as to limit the longitudinal movement of the members 70 relative to the shaft 50. The members 70 are biased together by the spring 69 so that the thread can be gripped between the members 70.

In operation, as shown in FIG. 4, when the axle 30 and the cams 32 are rotated by the knob 36, the second end 48 of each of the levers 40 can be caused to move toward or to move away from the respective gripping device 60. When the sleeve 61 moves toward the element 67 against the spring 69, the tension force applied to the thread will be increased, and the tension force applied to the thread will be decreased when the sleeve 61 moves away from the element 67 so that the tension force applied to the thread can be adjusted. The three gripping devices 60 are adjusted simultaneously.

It is to be noted that the disc 65 can be caused to move longitudinally relative to the sleeve 61 when the disc 65 is rotated relative to the sleeve 61 so that the disc 65 of each of the gripping devices can be caused to move toward and to move away from the element 67 and so that each of the gripping devices 60 can be adjusted individually.

Accordingly, the tension force applied to the thread can be adjusted by the thread tension adjusting device in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjusting device for a sewing machine having an arm for accommodating said adjusting device, said adjusting device comprising a casing fixed in said arm of said sewing machine, an axle rotatably supported in said casing and having a first end extended outward of said casing, a shaft fixed in said casing in parallel with said axle, a knob fixed to said first end of said axle and extended outward of said arm of said sewing machine, at least one cam fixed on said axle, a lever having a first end pivotally fixed on said casing and having a second end slidably engaged on said shaft and having a protrusion formed on a middle portion thereof for slidably engaging said cam, and a gripping device disposed beside said second end of said lever and including a pair of members, one of said pair of members being fixedly secured to said shaft and the other member being slidably engaged on said shaft and means disposed between said second end of said lever and said pair of members for biasing said pair of members together so that a thread is gripped between said pair of members, and when said second end of said lever is moved toward or moved away from said pair of members when said axle and said cam are rotated, a tension force applied to said thread is adjusted.

2. An adjusting device according to claim 1, wherein said lever has a notch formed in said second end thereof, said gripping device includes a sleeve slidably engaged on said shaft between said lever and said pair of members and contacted with said second end of said lever and including a key formed thereon for engagement with said notch of said lever so that said sleeve is limited to slide longitudinally along said shaft, a disc threadedly engaged on said sleeve and including at least one recess formed therein, and an element slidably engaged on said shaft between said disc and said pair of members and including at least one leg formed thereon for sliding engagement with said recess of said disc, and wherein said means for biasing is a spring disposed between said element and said disc so that said tension force applied to said thread is adjusted when said disc is rotated relative to said sleeve.

* * * * *